United States Patent [19]

Brühmann et al.

[11] Patent Number: 4,727,839

[45] Date of Patent: Mar. 1, 1988

[54] PNEUMATIC DIAPHRAGM CONTROL ELEMENT FOR A FUEL INJECTION APPARATUS IN INTERNAL COMBUSTION ENGINES

[75] Inventors: Werner Brühmann, Stuttgart; Werner Lehmann, Gerlingen; Matthias Schmidt, Stuttgart, all of Fed. Rep. of Germany

[73] Assignee: Robert Bosch GmbH, Stuttgart, Fed. Rep. of Germany

[21] Appl. No.: 938,070

[22] Filed: Mar. 10, 1986

[30] Foreign Application Priority Data

Mar. 9, 1985 [DE] Fed. Rep. of Germany ..... 3508519
Dec. 7, 1985 [DE] Fed. Rep. of Germany ..... 3543334

[51] Int. Cl.[4] ..... F02M 39/00
[52] U.S. Cl. ..... 123/383; 123/382
[58] Field of Search ..... 123/383, 382, 372, 389, 123/391, 364, 365

[56] References Cited

U.S. PATENT DOCUMENTS

| | | | |
|---|---|---|---|
| 2,569,664 | 10/1951 | Gewinner | 123/382 |
| 2,893,366 | 7/1959 | Nystrom | 123/382 |
| 3,149,619 | 9/1964 | Whalen | 123/382 |
| 3,776,210 | 12/1973 | Beasley | 123/382 |
| 3,795,233 | 3/1974 | Crews | 123/383 |
| 4,149,507 | 4/1972 | Little | 123/383 |
| 4,286,559 | 9/1981 | Ritter | 123/383 |
| 4,441,472 | 4/1984 | Knorreck | 123/382 |

FOREIGN PATENT DOCUMENTS

| | | | |
|---|---|---|---|
| 2537710 | 3/1977 | Fed. Rep. of Germany | 123/382 |
| 2029901 | 3/1980 | United Kingdom | 123/382 |

*Primary Examiner*—Carl Stuart Miller
*Attorney, Agent, or Firm*—Edwin E. Greigg

[57] ABSTRACT

A pneumatic diaphragm control element for a fuel injection apparatus for internal combustion engines, in particular for supercharged diesel engines, has a thrust rod that is axially displaceable between two end stop counter to the force of a restoring spring, which thrust rod acts upon a control member of the fuel injection apparatus and is connected to a pressure-actuated diaphragm. One end stop determines the position assumed by the thrust rod when there is no pressure and is embodied as a stop screw for the thrust rod. The second end stop defines the position assumed by the thrust rod with maximal pressure being exerted on the diaphragm, and to this end cooperates with a counterpart stop that is adjustably coupled with the thrust rod. For better adaptation of the regulating characteristic, the counterpart stop is embodied as a pre-stressed spring assembly with two stop positions, such that when the first stop position is attained, after the spring pre-stressing is overcome, a further displacement travel ($S_2$) of the thrust rod until the second stop position is attained is available.

13 Claims, 3 Drawing Figures

PNEUMATIC DIAPHRAGM CONTROL ELEMENT FOR A FUEL INJECTION APPARATUS IN INTERNAL COMBUSTION ENGINES

BACKGROUND OF THE INVENTION

The invention is based on a pneumatic diaphragm control element for a fuel injection apparatus in internal combustion engines, in particular supercharged Diesel engines.

In so-called supercharged engines, a pneumatic diaphragm control element of this kind acts as a charge-pressure-dependent full-load stop (CPS), which serves to reduce the quantity of fuel pumped at full load beyond a predetermined charge pressure, in the lower rpm range. The diaphragm control element may be mounted on the fuel injection pum of the fuel injection device and act via a control member on a supply quantity adjusting member, or it may be flanged to a centrifugal governor of the fuel injection apparatus and act via a control member on a governor lever, which in turn controls the supply quantity adjusting member.

In a known diaphragm control element of the above type (German Offenlegungsschrift No. 28 37 964), the counterpart stop is embodied as an adjusting nut that can be screwed onto an externally threaded portion of the thrust rod, and the adjusting nut is fixed on the thrust rod with a check nut after the maximum displacement travel of the thrust rod has been set. With the construction of the known diaphragm control element, it is possible to separately set the full-load quantity without charge pressure (the so-called intake quantity), the full-load quantity at full charge pressure (the so-called charger quantity), and the effective pressure range. The intake quantity is defined by means of the length of the stop screw that protrudes into the pressure chamber; the charger quantity is defined by the relative position of the adjusting nut on the thrust rod; and the pressure range is defined by the initial stress of the restoring spring, which can be adjusted by means of abutments.

However the known diaphragm element has only a linear adjusting characteristic within the effective pressure range; that is, the adjusting travel of the thrust rod is linearly dependent on the charge pressure prevailing in the pressure chamber, which is frequently inadequate in terms of the need to influence or control the fuel supply quantity.

OBJECT AND SUMMARY OF THE INVENTION

The pneumatic diaphragm control element according to the invention has the advantage over the prior art of attaining an improved determination of the control rod travel, for instance in accordance with charge pressure, that is required for controlling the fuel quantity. The pre-stressed spring assembly with the two stop positions enables a regulating characteristic in which—as before—a proportional adjusting movement of the thrust rod begins once a minimum charge pressure is attained in the pressure chamber. Once the first stop position of the spring assembly is attained, its spring pre-stressing force comes into play, so that the charge pressure must first rise to a second, higher minimum pressure before a further adjustment movement of the thrust rod, again proportionally dependent on the pressure rise, begins. Both the thrust rod position at the first minimum pressure and at the second minimum pressure that is higher than the first, and the total length of the thrust rod displacement can be very simply adjusted separately from one another and without affecting one another; as a result, it is for instance possible to attain a engine torque that is constant over a wide rpm range.

An advantageous embodiment of the invention is further disclosed by the structure revealed herein, whereby the steepness of the regulating characteristic in the second linear adjustment range can be additionally varied as compared with the steepness of the first linear adjustment range, thereby enabling better adaptation to given conditions.

Further embodiments of the invention disclosed individually or in combination facilitate manufacture, save time in assembly, and enable rapid adjustment and simple readjustment of the diaphragm control element during engine operation.

In an advantageous further embodiment of the invention, the spring assembly is screwed into an internal thread in the wall of the pressure chamber, and its installed position defines the further displacement travel of the thrust rod. This variant embodiment is advantageous especially if limited adjusting forces necessitate making the mass secured to the thrust rod as small as possible, to preclude unintentional adjusting movements caused by the forces of acceleration arising in the Diesel engine. If the spring assembly is designed as pointed out herein, then it can either be built in as a pre-adjusted spring assembly, for the sake of ease of assembly, or it can be used for a fully adjustable charge pressure stop. In that case, then both the displacement travel of the thrust rod for the two adjustment stages and the pre-stressing forces of the restoring spring and compression spring can be adjusted and readjusted separately from one another— and even independently if the initial setting sequence is correct.

Further characteristics of the invention provide for a compact structure of the diaphragm control element, in terms of the space required to house it.

The invention will be better understood and further objects and advantages thereof will become more apparen from the ensuing detailed description of preferred embodiments taken in conjunction with the drawings.

DESCRIPTION OF THE PREFERRED EMBODIMENTS

Figure 1:
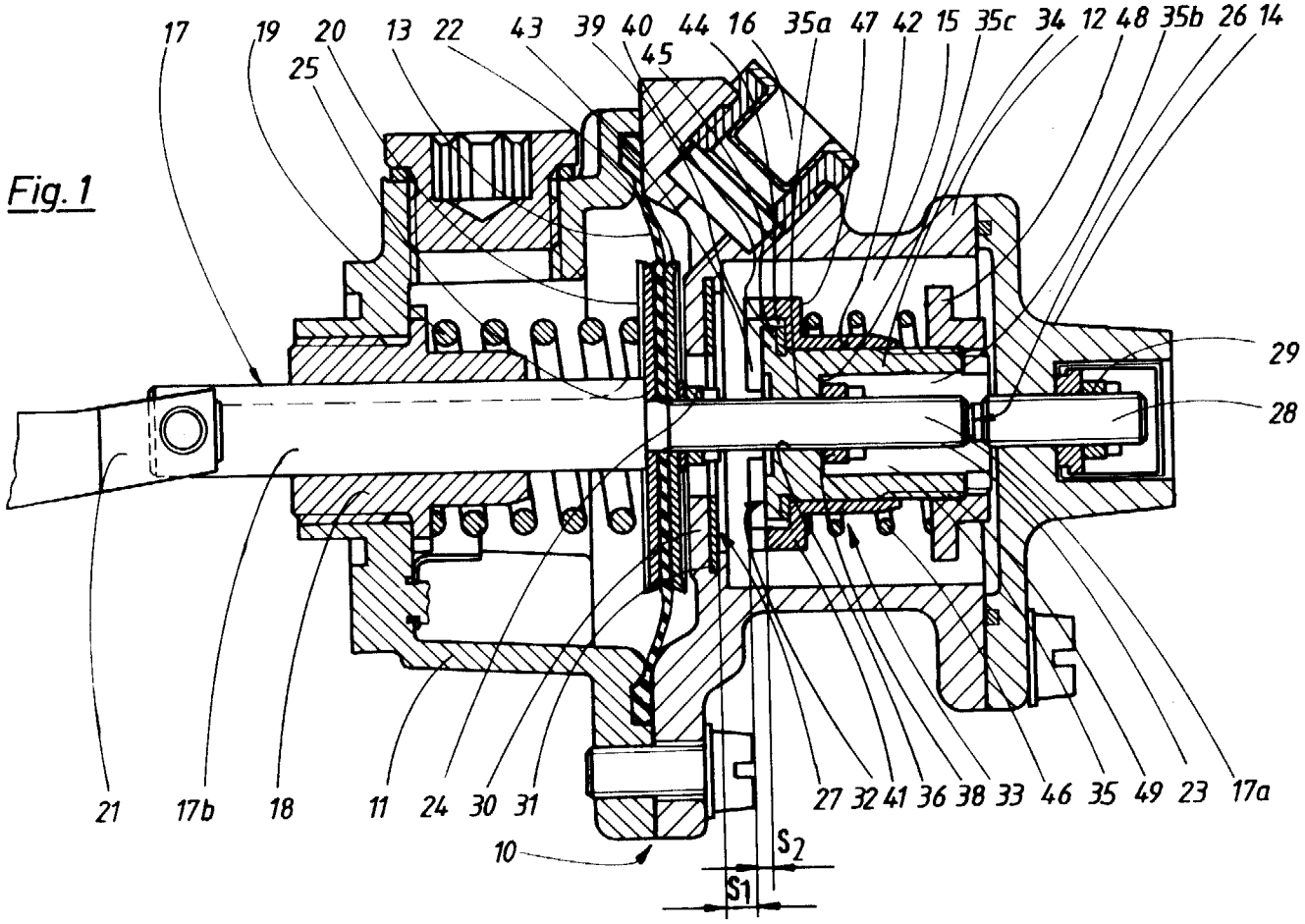
FIG. 1 is a longitudinal cross section taken through the first exemplary embodiment of a pneumatic diaphragm control element according to the invention in a charge-pressure-dependent full-load stop for a fuel injection apparatus in internal combustion engines.

The pneumatic diaphragm control element shown in FIG. 1 as a preferred first exemplary embodiment suitable for mounting on a fuel injection pump or centrifugal speed governor of a fuel injection apparatus is a final control element of a charge-pressure-dependent full-load stop and has a two-part housing 10, with first and second housing parts 11, 12 suitably fastened together, thereby fastening a diaphragm 13 in place between them. The second housing part 12 is covered on one end with a housing cap 14, which together with the diaphragm 13 defines a pressure chamber 15 in the second housing part 12, to which the charge air pressure prevailing in the intake line of the engine is supplied via a connection bore 16.

In the first housing part 11, a thrust rod 17 is guided in an axially displaceable manner in a bearing sleeve 18, which is screwed into the bottom of the first housing part 11 and forms an adjustable abutment for a restoring spring 19 that coaxially surrounds the thrust rod 17 and is supported on the diaphragm 13 via an interposed connecting plate 20. With its end protruding from the housing 10, the thrust rod 17 is arranged to cooperate via a articulatedly connected control member 21 with a governor rod, not shown, in the fuel injection apparatus.

With a section 17*a* of reduced diameter, the thrust rod 17 protrudes through the diaphragm 13 as far as the pressure chamber 15 in the second housing part 12 and is joined with the diaphragm 13 in that on the side of the diaphragm 13 facing the connecting plate 20, a further connecting plate 22 is fitted onto the thrust rod section 17*a* and is pressed by means of a tensioning nut 24, which can be screwed onto an external thread 23 of the thrust rod section 17*a*, against an annular shoulder 25 on the thrust rod section 17*b* having the larger diameter.

Counter to the force of the restoring spring 19, the thrust rod 17 is axially displaceable between two end stops 26, 27 integral with the housing by means of the diaphragm 13 when pressure is exerted on the pressure chamber 15. Both end stops 26, 27 are disposed in the pressure chamber 15. The first end stop 26 is embodied by a stop screw 28, which can be threaded into the housing cap 14 and is in alignment with the thrust rod 17. In the stop position selected, the stop screw 28 is fixed by means of a check nut 29 on the housing cap 14. In the pressureless initial position of the thrust rod 17 shown, the end face of the thrust rod section 17*a* rests against the stop screw 28. The stop screw 28 serves to define the initial position of the thrust rod 17 when the pressure chamber 15 is not under pressure, and thus serves to define the intake quantity. The second end stop 27 is disposed on an annular radial strut 30 that protrudes into the interior of the pressure chamber and is spaced axially apart from the housing cap 14; this stop 27 takes the form of an annular disk 31 of hardened spring steel. The annular disk 31 that is affixed to the housing cooperates with a counterpart stop 32 that is adjustably secured to the thrust rod 17, specifically to the thrust rod section 17*a*. The counterpart stop 32 determines the position of the thrust rod 17 at full charge pressure and thus defines the charge quantity, that is, the full-load quantity at full charge pressure.

The counterpart stop 32 is embodied as part of a pre-stressed spring assembly 33 having two stop positions, such that once the first stop position at the annular disk 31 is attained, after the thrust rod displacement travel $S_1$ has been performed and after the spring prestressing of the spring assembly 33 has been overcome, a further displacement travel $S_2$ of the thrust rod 17 is available before the second stop position at the annular disk 31 is attained. In the course of the further displacement travel $S_2$, the spring force of the spring assembly 33 and that of the restoring spring 19 are added together.

To this end, the spring assembly 33 has a cylindrical guide part 34 with an axial stepped bore 35. The bore section 35*a* having the smaller diameter has an internal thread 36, with which the guide part 34 is screwed onto the external thread 23 of the thrust rod section 17*a*. The guide part 34 is locked by a locking nut 38, which can be screwed onto the external thread 23 of the thrust section 17*a* in the interior of the bore section 35*b* having the larger diameter; the locking nut 38 is pressed against the transitional shoulder 35*c* located between the bore sections 35*a* and 35*b*. On the end face oriented toward the annular disk 31, the guide part 34 has a annular flange 39 that protrudes radially outward, the annular face of which that is remote from the annular disk 31 forms a driver shoulder 40 for a spring support element 41, which is held in an axially displaceable manner on an outer guide face 42 of the guide part 34.

The hollow-cylindrical spring support element 41 rests with its inner cylindrical wall on the outer guide face 42 of the guide part 34 and in its end face oriented toward the annular disk 31 it has a concentric recess 43, the diameter of which is greater than that of the annular flange 39 of the guide part 34. The depth of the recess 43 is dimensioned to be larger than the sum of the axial thickness of the annular flange 39 and the desired displacement travel $S_2$ of the guide part 34, or of the thrust rod 17, after attaining the first stop position of the spring assembly 33.

For exact setting of the displacement travel $S_2$, a spacer disk 45 is inserted between the driver shoulder 40 at the annular flange 39 and an annular bottom face 44 of the recess 43. By means of a compression spring 46 that coaxially surrounds the spring support element 41 and the guide part 34, the spring support element 41 is pressed with the annular bottom face 44 of the recess 43 against the spacer disk 45, which in turn is pressed against the driver shoulder 40 of the annular flange 39 on the guide part 34. To this end, the compression spring 46 is supported both on an annular support shoulder 47 of the spring support element 41 and on an adjusting ring 48, which can be threaded onto an externally threaded section 49 of the guide part 34. By screwing the adjusting ring 48 onto the guide part 34 to a variable extent, the pre-stressing of the compression spring 46 can be variably defined. The end face of the spring support element 41 is embodied such that the remaining annular surface on the end face and the outside diameter of the spring support element 41 correspond to the annular width and outside diameter of the annular disk 31 that is disposed concentrically with the thrust rod 17 and forms the second end stop 27. The spring assembly 33 is preassembled such that first the spring support element 41 is fitted onto the guide part 34, and the displacement travel $S_2$ is fixed by means of the spacer disk 45. Then the compression spring 46 is fitted on, and its pre-stressing is fixed by means of the adjusting ring 48. Then the thus pre-assembled and completely adjusted spring assembly 33 together with the spring suppor part 34 is screwed onto the external thread 23 of the thrust rod section 17*a* far enough that the displacement travel $S_1$ is fixed, and it is then locked in place with the locking nut 38.

To adjust the diaphragm control element, the basic position of the thrust rod 17 when the pressure chamber 15 is free of pressure is first established, with the stop screw 28. By means of the check nut 29, this position of the stop screw 28 is fixed. Then the beginning of adjustment of the displacement movement of the thrust rod 17, or in other words the minimum charge pressure $p_1$ required for initially displacing the thrust rod 17, is established by rotating the bearing sleeve 18 and thereby adjusting the pre-stressing of the restoring spring 19. Next the pre-stressing of the compression spring 46 is corrected if necessary by rotating the adjusting ring 48, such that the second beginning of adjustment of the thrust rod 17, once the first displacement travel $S_1$ has been performed, comes into play when the desired second minimum charge pressure $p_3$ is attained.

Figure 2:
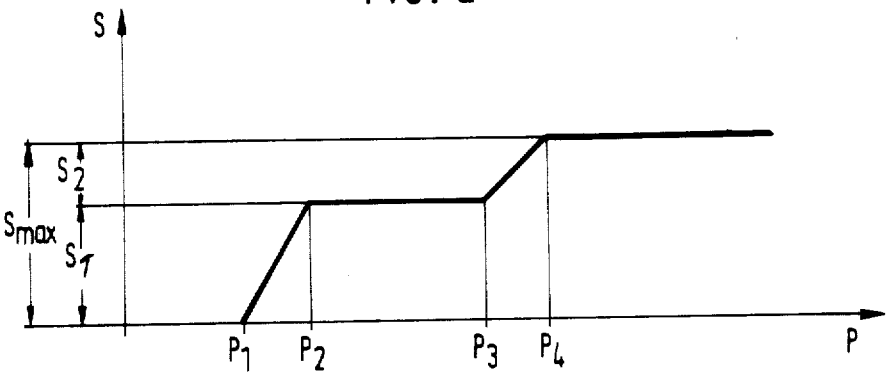
FIG. 2 is a diagram of the displacement travel of a thrust rod in accordance with the charge pressure in a pressure chamber of the diaphragm control element of FIG. 1.

By means of this adjustment of the diaphragm control element, its thrust rod 17 has a displacement travel characteristic curve that is dependent on the charge pressure p in the pressure chamber 15 as shown in FIG. 2. As this diagram shows, once the pre-stressing force of the restoring spring 19 is overcome at the charge pressure $p_1$, a first displacement movement of the thrust rod 17 begins, which is proportional to the increase in charge pressure from $p_1$ to $p_2$. Once the thrust rod 17 has covered the displacement travel $S_1$, the spring support element 41, which at its end protrudes axially beyond the guide part 34, strikes the annular disk 31 that embodies the second end stop 27. The thrust rod 17 can now be displaced relative to the blocked spring support element 41 only by carrying along the guide part 34. If the charge pressure in the pressure chamber 15 has risen to the value $p_3$, then the pre-stressing force of the compression spring 46 is overcome, and the second displacement movement of the thrust rod 17 over the displacement travel $S_2$ now begins. Upon attaining the elevated charge pressure $p_4$, which is also designated as the specified pressure, the end face of the guide part 34 strikes the annular disk 31, and the thrust rod 17 has reached its end position and has covered the maximal displacement travel $S_{max}$ that is the sum of the displacement travel $S_1$ and $S_2$.

The invention is not limited to the first exemplary embodiment described above. The two coaxial components of the spring assembly 33 that are fastened together, which in the first exemplary embodiment are embodied by the guide part 34 and the spring support element 41, do not need to be seated on the thrust rod; in the exemplary embodiment described below, they are instead retained in the second housing part 12, coaxially with the thrust rod 17.

Figure 3:
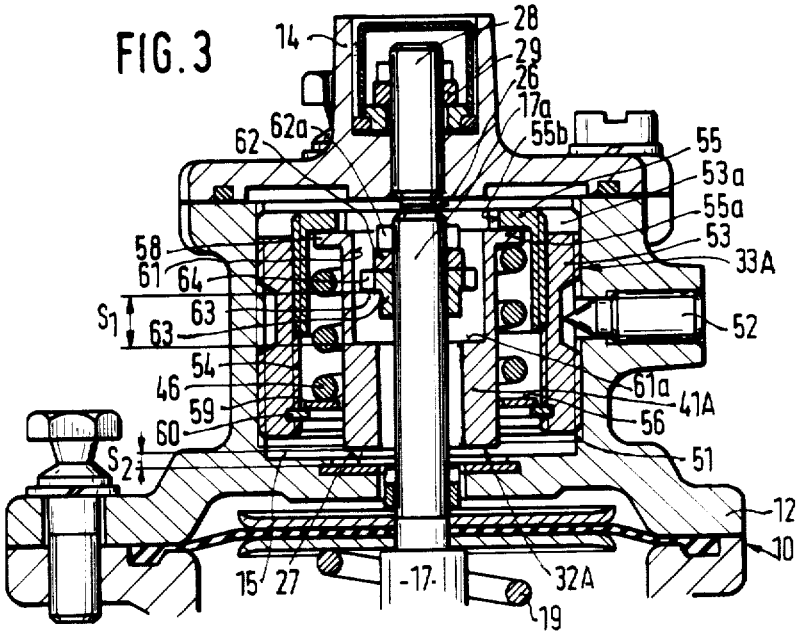
FIG. 3 is a fragmentary longitudinal cross section corresponding to FIG. 1 but taken through the second exemplary embodiment.

As already noted in the paragraph above, the second exemplary embodiment shown in FIG. 3 differs from the first embodiment shown in FIG. 1 substantially in terms of the modified embodiment of the spring assembly 33A. Identical elements will therefore carry the same reference numerals, and modified elements will be provided with the letter A, while new elements will have new reference numerals.

The spring assembly 33A is screwed into an internal thread 51 in the wall of the pressure chamber 15, and on its end face it forms the counterpart stop 32A. Additionally the spring assembly 33A is spaced apart from the second end stop 27 by a distance that defines the further displacement travel $S_2$ of the thrust rod, and it is positionally secured in this installed position in the second housing part 12 of the control element housing 10, coaxially with the thrust rod 17, by a securing screw 52. One of the two components of the spring assembly 33A that are disposed such that they are displaceable relative to one another and are clamped together by means of the compression spring 46 is embodied by a threaded sleeve 53 having an adjusting sleeve 55 screwed into a internal thread 54 of the sleeve 53, and the second component is a spring support element 41A disposed such that it is axially displaceable between and coaxial with the thrust rod 17 and the threaded sleeve 53 having the adjusting sleeve 55. The compression spring 46 is supported at one end on a suppor shoulder 56 inside the threaded sleeve 53, and at the other end on an annular flange 58 that protrudes radially from the spring support element 41A. The annular flange 58, in the position shown, is in turn pressed by the compression spring 46 against an inner shoulder 55*a* of the adjusting sleeve 55, and the support shoulder 56 is formed by an end face, oriented toward the compression spring 46, of an annular disk 59, which in turn rests on an inner snap ring 60 inserted into an annular groove not identified by a reference numeral.

A recess 61 inside the spring support element 41A that is open toward the first end stop 26, formed by the stop screw 28, forms a stop shoulder 61*a*, and the thrust rod 17, on its section 17*a* provided with a thread, in the vicinity between the first end stop 26 and the stop shoulder 61*a*, carries an adjusting nut 63 that is secured in the installed position shown by means of a check nut 62. In its position of repose, shown, the thrust rod 17 rests on the first end stop 26, and the adjusting nut 63 is adjusted such that a spacing distance that defines the first displacement travel $S_1$ is available between the stop shoulder 61*a* in the spring support element 41A and a stop face 63*a* on the adjusting nut 63. As FIG. 3 shows, the stop face 63*a* is located on a step between a section of this adjusting nut 63 not identified by reference numeral and having a reduced diameter and an annular collar 64 of this same nut 63. The annular collar 64 has recesses on its circumference, which are accessible to an adjusting tool, and the check nut 62 has corresponding recesses 62*a* on its circumference, so that both nuts 62, 63 can be adjusted and locked by a double-walled tube-type tool. The threaded sleeve 53, too, has transverse grooves 53*a* in its end face which are provided so that a tool can engage them, and the adjusting sleeve 55 has a hexagonal socket 55*b* or similarly shaped opening for engagement by a suitable tool. Thus all the important operating characteristics can be adjusted, and readjusted later if needed, in an infinitely variable manner and independently of one another, if the prescribed sequence of adjustment is adhered to. In this second exemplary embodiment, an identical displacement travel characteristic curve is attained as in the first exemplary embodiment shown in FIG. 1, so that the diagram of FIG. 2 applies to this second example as well.

The adjustment of the second exemplary embodiment of the diaphragm control element shown in FIG. 3 differs in terms of some work steps from that of the first exemplary embodiment shown in FIG. 1. Adjusting the illustrated basic setting of the thrust rod 17 when the chamber 15 is without pressure by means of the stop screw 28 secured by the check nut 29, and adjusting the pre-stressing of the restoring spring 19 for the initial displacement of the thrust rod 17 that begins at the minimum charge pressure $p_1$ are effected in the same manner as in the first exemplary embodiment.

After the basic adjustment of the thrust rod 17 for the initial point at $p_1$ on the displacement travel characteristic curve of FIG. 2 has been completed the housing lid 14 is taken off, and the spring assembly 33A and the adjusting nut 63 are installed in their illustrated position, in which the displacement travels $S_1$ and $S_2$ are controlled. To this end, first the spring assembly 33A is inserted far enough in that the spring support element 41A rests with its end face against the second end stop 27. After that the thrust rod is adjusted into a position for the maximal displacement travel $S_{max}$, which is the sum of the two displacement travels $S_1$ and $S_2$ The thrust rod 17 is fixed in this position, and the adjusting nut 63 is screwed in until its stop face 63*a* rests on the stop shoulder 61*a* and is secured in this position by the check nut 62. After that, the thrust rod 17 is adjusted back toward the stop 26 by the amount of the displacement travel $S_2$, and the threaded sleeve 53 is adjusted back by the same amount, so that the stop shoulder 61*a* again rests on the stop face 63*a*. The spring support element 41A is now in the installation position shown, which defines the displacement travel $S_2$. If the prestressing of the compression spring 46 was already preset before installation, by adjusting the adjustment sleeve 55, then the entire adjustment process is now complete. If the housing lid 14 is put back on, the thrust rod 17 then strikes the first end stop 26, and the stop shoulder 61*a* then assumes the position spaced apart from the stop face 63*a* by the distance that defines the displacement path $S_1$.

If an adjustment or correction of the spring prestressing force of the compression spring is still necessary, despite a pre-adjusted spring assembly 33A or if the spring assembly 33A has not been adjusted, then this must be done after the adjustment of the displacement travel $S_2$, by holding the adjusting sleeve 55 steady with a tool introduced into the hexagonal socket 55*b* and turning only the threaded sleeve 53. To prevent any change in the installed position of the adjusting sleeve 55 and of the spring support element 41A, the internal threads 51 and 54 have the same pitch.

In this second exemplary embodiment accordingly, both the displacement travels $S_1$ and $S_2$ and the measurement points for the appropriate beginning of adjustment at the charge pressures $p_1$ and $p_3$ can be adjusted and readjusted in an infinitely variable manner.

Here again, as in the first exemplary embodiment, the components that are clamped together to make the pre-adjusted spring assembly 33A, that is, the threaded sleeve 53 having the adjusting sleeve 55 an the spring support element 41A, are operatively connected to the thrust rod 17 on the one hand and to the second end stop 27 on the other in such a way that once the first displacement travel $S_1$ has been performed, counter to the restoring force of the restoring spring 19, a first stop position is reached, and then after the pre-stressing force of the compression spring 46 is overcome, by the relative displacement of these components counter to the spring force of the compression spring 46, the further displacement travel $S_2$ of the thrust rod 17 as far as the second stop position at the second end stop 27 is available. Thus in the further displacement travel $S_2$ the thrust rod restoring force is increased by the spring force of the compression spring 46, and as in the first exemplary embodiment the result is the flatter course shown in FIG. 2 for the displacement travel characteristic curve between charge pressures $p_3$ and p4 as compared with the steeper course between $p_1$ and $p_2$.

The foregoing relates to preferred exemplary embodiments of the invention, it being understood that other variants and embodiments thereof are possible within the spirit and scope of the invention, the latter being defined by the appended claims.

What is claimed and desired to be secrued by Letters Patent of the United States is:

1. A pneumatic diaphragm control element for a fuel injection apparatus having a control member in internal combustion engines, particularly supercharged Diesel engines, comprising a housing, a thrust rod arranged to act on said control member of said fuel injection apparatus, said thrust rod being connected to a diaphragm fastened in said housing and arranged to protrude into a pressure chamber defined on one side by said diaphragm and on the other side by housing cover, a restoring spring in said housing adapted to cooperate with said thrust rod and an adjustable abutment in said housing, said pressure chamber arranged to enclose first and second end stops for limiting the axial displacement of said thrust rod, said first end stop including a screw means adjustably supported in said housing cover in axial alignment with an end of said thrust rod and arranged to define a position of repose assumed by said thrust rod determined by a pressure-free condition in said pressure chamber, said second of said end stops disposed in said pressure chamber is adapted to define the operating position of said thrust rod assumed at a pre-specified pressure in said pressure chamber, said second end stop further arranged to cooperate with a counterpart stop that is adjustable relative to said thrust rod and is coupled therewith over at least a portion of the displacement travel thereof, said counterpart stop being further embodied as part of a prestressed spring assembly which contains at least one compression spring having at least two axially disposed stop positions, said spring assembly is disposed in the pressure chamber and embodied as a pre-assembled unit with infinitely adjustable spring pre-stressing force of the compression spring, said spring assembly includes two components that are coaxial with said thrust rod and said compression spring is disposed axially therebetween, said two components being displaceable relative to one another and operatively connected to said thrust rod so that a relative movement that compresses said compression spring does not begin until after the attainment of first stop position whereby a first displacement travel ($S_1$) of said thrust rod upon attaining said first stop position and after the spring pre-stressing force of the compression spring is overcome, a further displacement travel ($S_2$) of said thrust rod is available up to the attainment of said second stop position at said second end stop.

2. A diaphragm control element as defined by claim 1, in which said spring assembly is embodied so that said thrust rod restoring force exerted by said restoring spring is increased, in said further displacement travel ($S_2$), by said spring force of said compression spring of said spring assembly.

3. A diaphragm control element as defined by claim 1, in which said spring assembly is affixed onto said thrust rod and is held in a positionally secured manner spaced apart from said second end stop by a distance that defines said first displacement travel ($S_1$).

4. A diaphragm control element as defined by claim 2, in which said spring assembly is affixed onto said thrust rod and is held in a positionally secured manner spaced apart from said second end stop by a distance that defines said first displacement travel ($S_1$).

5. A diaphragm control element as defined by claim 4, in which one of said components is embodied by a guide part having a outer guide face and an adjusting ring and the other of said components is embodied by a spring support element that is axially displaceable on said outer guide face and further that said compression spring is supported at one end on said adjusting ring and on the other end on said spring support element, said spring support element arranged to rest on a radial driver shoulder of said guide part and on a face oriented toward said second end stop which protrudes axially beyond said guide part wherein the extent of protrusion of said face is dimensioned to be equal to said further displacement travel ($S_2$).

6. A diaphragm control element as defined by claim 5, in which said guide part has an axial stepped bore and a reduce threaded portion for fastening onto said thrust rod, and further that said guide part is provided with a radially offstanding annular flange which is in proximity to said driver shoulder.

7. A diaphragm control element as defined by claim 5, in which said spring support element has a concentric recess having a diameter which is larger than the outer diameter of said annular flange of said guide part and the axial depth of which diameter is dimensioned to be at least equal to the sum of the axial width of said annular flange of said guide part and the desired further axial displacement travel ($S_2$) of said thrust rod.

8. A diaphragm control element as defined by claim 6, in which said spring support element has a concentric recess having a diameter which is larger than the outer diameter of said annular flange of said guide part and the axial depth of which diameter is dimensioned to be at least equal to the sum of the axial width of said annular flange of said guide part and the desired further axial displacement travel ($S_2$) of said thrust rod.

9. A diaphragm control element as defined by claim 7, in which further displacement travel ($S_2$) of said thrust rod is achieved by insertion of at least one spacer disk between said driver shoulder and said spring support element.

10. A diaphram control element as set forthin claim 5, in which said second end stop is disposed on an annular radial web which protrudes into the interior of said pressure chamber and spaced axially apart from the housing cover and is embodied as an annular disk held concentrically with said thrust rod on the radial web, further wherein said annular disk has an outer diameter and the annular width which corresponds to the embodiment of said end face of said spring support element.

11. A diaphragm control element as defined by claim 1, in which said pressure chamber further includes a threaded wall area and said spring assembly is received therein said spring assembly further being positionally secured in said housing with a face portion spaced apart from said second end stop by a distance that defines said further displacement travel ($S_2$).

12. A diaphragm control element as defined by claim 11, in which one of said two components is embodied by a threaded sleeve having an adjusting sleeve secured thereto and said second component is embodied by a spring support element disposed axially displaceably between, and coaxial with, said thrust rod and said threaded sleeve having said adjusting sleeve, and further that said compression spring is supported at one end on a support shoulder inside said threaded sleeve and is supported o the other end on an annular flange radially protruding from said spring support element, the annular flange being in turn pressed by said compression spring so that it rests on an inner shoulder of said adjusting sleeve.

13. A diaphragm control element as defined by claim 12, in which said spring support element further includes stop shoulder that is open toward said first end stop, and further that said thrust rod carries an adjusting nut positionally manner between said first end stop and said stop shoulder, and further that with said thrust rod arranged to rest on said first end stop, a distance which defines said first displacement travel ($S_1$) exists between said stop shoulder and a stop face on said adjusting nut.

* * * * *

UNITED STATES PATENT AND TRADEMARK OFFICE

CERTIFICATE OF CORRECTION

PATENT NO. : 4,727,839

DATED : March 1, 1988

INVENTOR(S) : Werner Bruhmann, Werner Lehmann, Matthias Schmidt

It is certified that error appears in the above-identified patent and that said Letters Patent are hereby corrected as shown below:

On the Title Page, Item [21] should read:

[21] Appl. No.: 838,070

Signed and Sealed this

Twenty-eighth Day of June, 1988

*Attest:*

DONALD J. QUIGG

*Attesting Officer*

*Commissioner of Patents and Trademarks*